US009651901B2

(12) United States Patent
Mukai

(10) Patent No.: US 9,651,901 B2
(45) Date of Patent: May 16, 2017

(54) FIXING DEVICE AND IMAGE FORMING APPARATUS

(71) Applicant: Sharp Kabushiki Kaisha, Osaka (JP)

(72) Inventor: Kan Mukai, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 15/048,156

(22) Filed: Feb. 19, 2016

(65) Prior Publication Data

US 2016/0313679 A1 Oct. 27, 2016

(30) Foreign Application Priority Data

Apr. 27, 2015 (JP) ..... 2015-090591

(51) Int. Cl.
*G03G 15/20* (2006.01)

(52) U.S. Cl.
CPC . *G03G 15/2025* (2013.01); *G03G 2215/0132* (2013.01)

(58) Field of Classification Search
USPC ..... 399/107, 110, 122, 320, 327
See application file for complete search history.

(56) References Cited

U.S. PATENT DOCUMENTS 5,903,809 A * 5/1999 Tomatsu ..... G03G 15/2025 15/256.5
5,999,786 A * 12/1999 Saito ..... G03G 15/2025 15/256.51
6,026,272 A * 2/2000 Kusaka ..... G03G 15/2064 219/216
6,334,041 B1 * 12/2001 Oota ..... G03G 15/2025 399/326
9,217,964 B2 * 12/2015 Hatazaki ..... G03G 15/2025

FOREIGN PATENT DOCUMENTS

JP 2005-164717 A 6/2005

* cited by examiner

*Primary Examiner* — Hoan Tran
(74) *Attorney, Agent, or Firm* — Renner, Otto, Boisselle & Sklar, LLP

(57) ABSTRACT

A fixing device includes a cleaning member configured to clean a fixing member and a re-adhering member to which toner that adheres to the cleaning member is caused to re-adhere. The re-adhering member is disposed so as to face the fixing member. A surface of the cleaning member, which makes contact with the fixing member, may be constituted by a nonmetal member, and a surface of the re-adhering member, which makes contact with the cleaning member, may be constituted by a metal member.

20 Claims, 9 Drawing Sheets

FIXING DEVICE AND IMAGE FORMING APPARATUS

CROSS-REFERENCE TO RELATED APPLICATIONS

This application claims priority under 35 U.S.C. §119 (a) on Patent Application No. 2015-090591 filed in Japan on Apr. 27, 2015, the entire contents of which are herein incorporated by reference.

BACKGROUND OF THE INVENTION

Field of the Invention

The present invention relates to a fixing device that fixes an unfixed image (specifically, a toner image visibly formed) on a recording sheet such as regular paper by a fixing nip portion of a fixing member constituted by a heating member and a pressure member, using image forming methods such as electrophotography, electrostatic recording and magnetography. More particularly, the present invention relates to a fixing device that includes cleaning means for collecting residues such as toner and paper powder that adhere to the fixing member.

Description of Related Art

Conventionally, fixing devices including cleaning means for collecting residues such as toner and paper powder that adhere to a fixing member have been provided. For example, a fixing device for collecting residues that adhere to a fixing member is known, which is configured to collect, by an oil roller that is impregnated with oil (silicone oil), residues such as toner and paper powder that adhere to the fixing member (for example, see JP 2005-164717 A, which is hereinafter referred to as "Patent Document 1").

Patent Document 1 discloses a fixing device including: a fixing roller; a pressure roller pressed against the fixing roller; a plurality of heat rollers that is pressed against the fixing roller and that has built-in heating means; and cleaning means for cleaning a surface of the heat roller. The cleaning means includes: a cleaning roller pressed against the heat roller; and a collecting roller pressed against the cleaning roller. The cleaning roller is constituted by felt impregnated with silicone oil or sponge rubber such as silicone sponge. The collecting roller is constituted by a hollow tube made of aluminum.

Also, in the fixing device described in Patent Document 1, the fixing roller, the heat roller, the cleaning roller (oil roller) and the collecting roller are arranged directly in this order (disposed in line). That is, the collecting roller is disposed away from the heat roller relative to the cleaning roller (oil roller). For this reason, although the collecting roller is made of a metal, its temperature is lower than the temperature of the cleaning roller (oil roller) that receives heat directly from the heat roller. This temperature relationship is more aggressively defined in Patent Document 1, i.e., the temperature of the heat roller is set to be constantly lower than the temperature of the cleaning roller (oil roller).

The fixing device described in Patent Document 1 has an advantageous effect that residues are easily accumulated due to viscosity of oil of the cleaning roller (oil roller). On the other hand, oil has good releasability, which results in a problem that the residues once accumulated return to the heat roller.

In this case, the fixing device described in Patent Document 1 includes the collecting roller that collects minute substances that adhere to the cleaning roller (oil roller). However, as described above, since the fixing roller, the heat roller, the cleaning roller (oil roller) and the collecting roller are arranged directly in this order (disposed in line), the collecting roller made of the metal has the temperature lower than the temperature of the cleaning roller (oil roller). Thus, the minute substances (specifically, toner components) that adhere to the cleaning roller (oil roller) hardly adhere to the collecting roller, and may remain on the cleaning roller (oil roller).

Therefore, there is a problem that the residues once accumulated on the cleaning roller (oil roller) return to the heat roller and further to the fixing roller so as to re-adhere to the sheet, which rather results in the sheet being likely to be contaminated.

SUMMARY OF THE INVENTION

An object of the present invention is to provide a fixing device that can collect more reliably residues on a fixing member, by proposing cleaning means not using any oil roller and further devising an arrangement of the cleaning means, and to provide an image forming apparatus including the fixing device.

A fixing device of the present invention includes: a cleaning member configured to clean a fixing member; and a re-adhering member to which toner that adheres to the cleaning member is caused to re-adhere. The re-adhering member is disposed so as to face the fixing member. A surface of the cleaning member, which makes contact with the fixing member, may be constituted by a nonmetal member. A surface of the re-adhering member, which makes contact with the cleaning member, may be constituted by a metal member.

Also, in the fixing device of the present invention, it is preferable that the re-adhering member is disposed at a location where a temperature of the re-adhering member is higher than a temperature of the cleaning member.

With the above configuration in which the re-adhering member is disposed so as to face the fixing member, the re-adhering member can absorb radiant heat from the fixing member more effectively, which results in the temperature of the re-adhering member being maintained higher than the temperature of the cleaning member. Since the temperature of the re-adhering member is maintained higher than the temperature of the cleaning member, it is possible to fuse or soften, to a certain extent, the toner that adheres to the cleaning member. Accordingly, the toner can easily adhere to the re-adhering member.

The fixing device of the present invention may further include a cleaning pad configured to clean the re-adhering member.

With the configuration including the cleaning pad, the toner that adheres to the re-adhering member can be further cleaned.

In the fixing device of the present invention, a support member that supports the cleaning pad may be a metal member.

With the configuration in which the support member that supports the cleaning pad is a metal member, the temperature of the support member is also raised by the radiant heat from the fixing member. As a result, the re-adhering member is heated via the cleaning pad supported by the support member (or due to radiant heat directly from the support member), thus it is possible to maintain the temperature of the re-adhering member, i.e., to obtain a temperature-keeping effect.

Also, in the fixing device of the present invention, the fixing member may be constituted by a heating member and a pressure member that form a fixing nip portion. The cleaning member and the re-adhering member may be provided on either one or both of the heating member and the pressure member.

Also, in the fixing device of the present invention, a fixing roller or a fixing belt may be used as the heating member, and a pressure roller may be used as the pressure member.

Also, an image forming apparatus of the present invention includes the fixing device having the respective configurations as described above.

With the above-described configuration of the present invention, the re-adhering member is disposed in the vicinity of the fixing member so as to absorb more effectively the radiant heat from the fixing member. Thus, the temperature of the re-adhering member can be set (maintained) higher than the temperature of the cleaning member. Accordingly, it is possible to fuse or soften, to a certain extent, the toner that adheres to the cleaning member by the temperature of the re-adhering member itself, so that the toner can reliably re-adhere to the re-adhering member. Thereby, it is possible to prevent the toner that adheres to the cleaning member from returning to the fixing member, which results in efficient collection of the toner.

DESCRIPTION OF THE PREFERRED EMBODIMENTS

Hereinafter, description will be given on embodiments according to the present invention with reference to the drawings.

Figure 1:
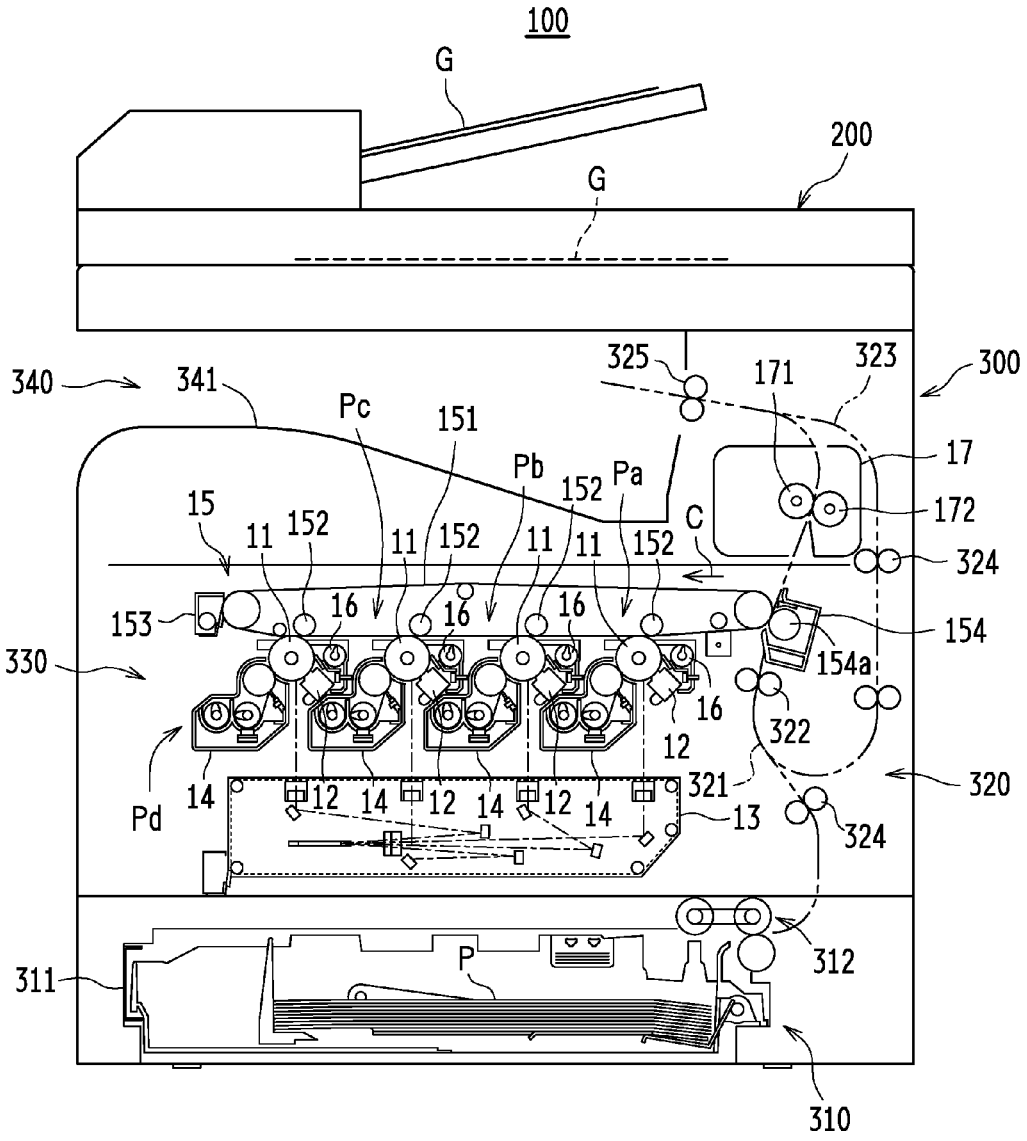
FIG. 1 is a schematic longitudinal cross-sectional view showing an image forming apparatus including a fixing device, which is viewed from the front side, according to embodiments of the present invention.

FIG. 1 is a schematic longitudinal cross-sectional view showing an image forming apparatus 100 including a fixing device 17, which is viewed from the front side, according to the embodiments of the present invention.

The image forming apparatus 100 has a copying function to read an image on an original sheet G and form the image on a recording sheet P such as recording paper. The image forming apparatus 100 includes: an image reading device 200 that reads the image on the original sheet G; and a main body 300 of the image forming apparatus 100 that forms the image on the recording sheet P.

The main body 300 of the image forming apparatus 100 includes: a sheet feed unit 310; a sheet transport unit 320; an image forming unit 330; and a sheet discharge portion 340. The main body 300 is horizontally installed.

The image forming unit 330 handles image data corresponding to a color image using black (K), cyan (C), magenta (M) and yellow (Y) or corresponding to a monochrome image using a single color (e.g., black). For this reason, the image forming unit 330 includes, in order to generate four kinds of images corresponding to four colors, each four photosensitive drums 11, charging units 12, development devices 14, intermediate transfer rollers 152 of a transfer device 15, and drum cleaning devices 16 respectively associated with black, cyan, magenta, and yellow. Thus, four image stations Pa, Pb, Pc and Pd are constituted. Note that the same reference numeral is used for indicating each of the members substantially having the same configuration in the respective image stations Pa, Pb, Pc and Pd.

When the main body 300 of the image forming apparatus 100 forms the image, an intermediate transfer belt 151 of the transfer device 15 is moved around in the direction indicated by an arrow C, while the respective photosensitive drums 11 are rotated. Thus, each of the charging units 12 charges a surface of the corresponding photosensitive drum 11 at a predetermined potential uniformly. An optical scanning device 13 causes each surface of the corresponding photosensitive drum 11 to be exposed to light so as to generate an electrostatic latent image on each surface. Each of the development devices 14 develops the electrostatic latent image on the surface of the corresponding photosensitive drum 11 so as to form a toner image (unfixed image) on the surface of the corresponding photosensitive drum 11. In this way, each toner image of the corresponding color is formed on the surface of the corresponding photosensitive drum 11. After that, each of the drum cleaning devices 16 removes and collects residual toner on the surface of the corresponding photosensitive drum 11.

Then, while the intermediate transfer belt 151 is moved around in the direction indicated by the arrow C, the intermediate transfer roller 152 to which transfer bias is applied causes the toner image of each color formed on the surface of the corresponding photosensitive drum 11 to be sequentially transferred and superimposed to each other on the intermediate transfer belt 151 so as to form a color toner image on the surface of the intermediate transfer belt 151. Thus, the color toner image is formed on the intermediate transfer belt 151. After that, a belt cleaning device 153 removes and collects residual toner on the surface of the intermediate transfer belt 151.

Meanwhile, in the sheet feed unit 310, the recording sheet P stacked in a sheet feed cassette 311 is drawn from the sheet feed cassette 311 by a sheet feed roller portion 312 so as to be transported to the image forming unit 330 via a sheet transport path 321 of the sheet transport unit 320. The sheet transport path 321 is provided with registration rollers 322, respective transport rollers 324 and discharge rollers 325. The registration rollers 322 temporarily stop the recording sheet P to align a leading edge of the recording sheet P, and re-start the transportation of the recording sheet P at a timing when the color toner image is transferred in a transfer nip region between the intermediate transfer belt 151 and a transfer roller 154*a* of a secondary transfer device 154.

The recording sheet P, which has been transported from the sheet feed unit 310 to the image forming unit 330 via the sheet transport path 321 of the sheet transport unit 320, is transported with being sandwiched in the transfer nip region between the intermediate transfer belt 151 and the transfer roller 154*a*, while the color toner image on the surface of the intermediate transfer belt 151 is transferred on the recording sheet P by the transfer roller 154*a* to which transfer bias is applied. Then, the recording sheet P is sandwiched between a fixing roller 171 and a pressure roller 172 of the fixing device 17 so as to be heated and pressurized, thus the color toner image is fixed on the recording sheet P. The recording sheet P is further transported toward the sheet discharge portion 340 so as to be discharged onto a discharge tray 341 of the sheet discharge portion 340 via the discharge rollers 325.

When image forming is performed not only on the front surface but also on the back surface of the recording sheet P, the recording sheet P, on the front surface of which the toner image has been fixed by the fixing device 17, is transported in the reverse direction by the discharge rollers 325 toward a reverse transport path 323, thus, the front and back of the recording sheet P are reversed by the reverse transport path 323. Then the recording sheet P is guided again to the registration rollers 322 so that a toner image is formed and fixed on the back surface of the recording sheet P, similarly to the front surface of the recording sheet P. Thus, the recording sheet P is discharged onto the discharge tray 341 of the sheet discharge portion 340.

Next, description will be given on the fixing device 17 according to the embodiments of the present invention.

First Embodiment

Figure 2:
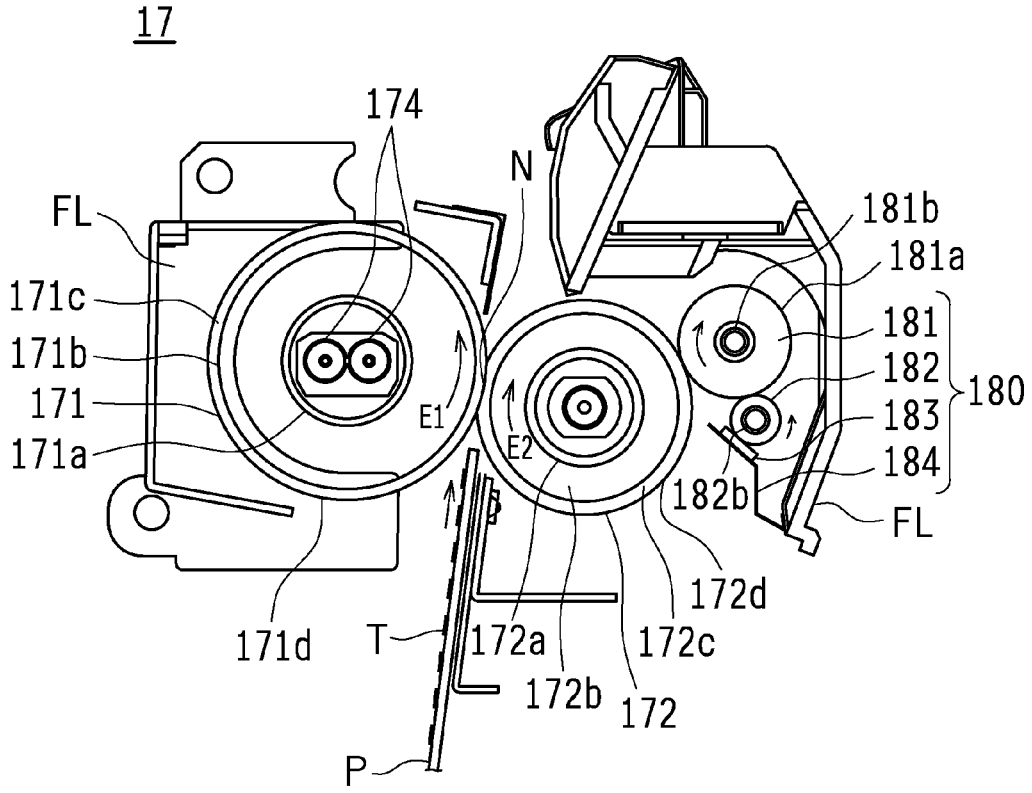
FIG. 2 is a schematic longitudinal cross-sectional view showing a main part, viewed from the front side, of the fixing device according to a first embodiment.
Figure 3:
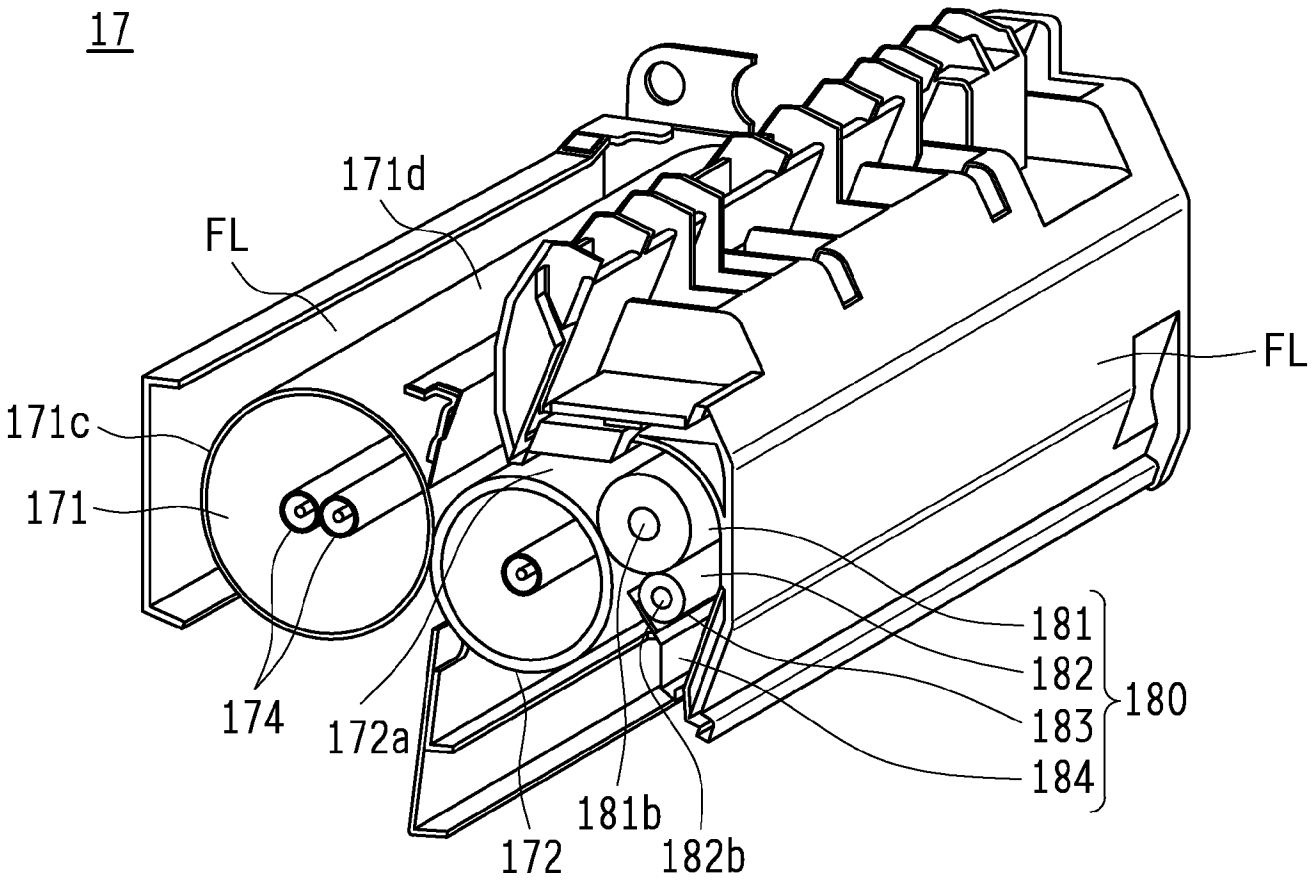
FIG. 3 is a perspective view showing partly a schematic cross-section viewed from the front side of the main part of the fixing device according to the first embodiment.

FIG. 2 is a schematic longitudinal cross-sectional view showing a main part, viewed from the front side, of the fixing device 17 according to the first embodiment. FIG. 3 is a perspective view showing partly a schematic cross-section viewed from the front side of the main part of the fixing device 17 according to the first embodiment.

The fixing device 17 includes: the fixing roller 171 (one example of a fixing member) that fixes a toner image (unfixed image made of toner T) on the recording sheet P; and the pressure roller 172 (one example of the fixing member) that faces the fixing roller 171. In the fixing device 17, the fixing roller 171 and the pressure roller 172 press against each other, thereby forming a fixing nip portion N that is a fixing nip region between the fixing roller 171 and the pressure roller 172. Note that the fixing device 17 further includes a pressing device (not shown) that serves as pressing means pressing the pressure roller 172 against the fixing roller 171. Since the pressing device can have a configuration conventionally known, the description thereon is omitted here. This configuration of the pressing device is commonly used in the embodiments described hereinafter.

In the first embodiment, a heat source 174 such as a halogen heater lamp is provided inside the fixing roller 171. A roller surface 171*d* is heated by the heat source 174.

Specifically, the fixing roller 171 includes a rotating shaft 171*a* that is rotatably provided in a main body frame FL of the fixing device 17 via a bearing (not shown). The fixing roller 171 includes a cylindrical-shaped core metal 171*b* and a surface layer 171*c* having elasticity (cushioning property, or flexibility). The heat source 174 is provided inside the core metal 171*b*. With the above configuration of the fixing roller 171, the roller surface 171*d* is heated by the heat source 174 so that the heat of the roller surface 171*d* is conducted to the toner T on the recording sheet P. Thus, the fixing roller 171, against which the pressure roller 172 is pressed in a state in which the recording sheet P is interposed therebetween, sandwiches and holds the recording sheet P in the fixing nip portion N between the pressure roller 172, while heating and fixing the toner T on the recording sheet P together with the pressure roller 172.

For the core metal 171*b*, it is possible to use, for example, a metal such as a free-cutting metal material (SUM material), a stainless steel material (SUS material), aluminum, iron or copper, or an alloy of any of these. For the surface layer 171*c*, it is possible to use, for example, a porous resin material or a foamed resin material. Representative examples of the foamed resin materials include rubber foam such as urethane rubber (urethane foam) or silicone rubber (silicone foam).

The pressure roller 172 includes a rotating shaft 172*a* that is rotatably provided in the main body frame FL of the fixing device 17 via a bearing (not shown). The pressure roller 172 includes a core metal 172*b* and a release layer 172*c* having releasability. The release layer 172*c* is disposed on the core metal 172*b*.

For the core metal 172*b*, it is possible to use the same material as used for the fixing roller 171. Furthermore, for the release layer 172*c*, it is possible to use, for example, fluororesin such as PFA (copolymer of tetrafluoroethylene and perfluoroalkylvinylether) or PTFE (polytetrafluoroethylene).

Although no heat source is provided in the pressure roller 172 in the first embodiment, the pressure roller 172 may include the heat source.

Also, the pressure roller 172 is provided with cleaning means 180 for collecting minute substances such as toner and paper powder that adhere to a roller surface 172*d* (specifically, the surface of the release layer 172*c*) of the pressure roller 172.

The cleaning means 180 includes: a sponge roller 181 that is pressed against the roller surface 172*d* of the pressure roller 172; and a metal roller 182 that is pressed against a roller surface 181*a* of the sponge roller 181. The metal roller 182 is disposed in the vicinity of the pressure roller 172. In the first embodiment, the metal roller 182 is disposed adjacent to the pressure roller 172 so that they face each other without interference of the sponge roller 181. Thus, the metal roller 182 is disposed to receive directly radiant heat from the pressure roller 172.

The rotating shaft 181*b* of the sponge roller 181 and a rotating shaft 182*b* of the metal roller 182 are disposed in parallel with the rotating shaft 172*a* of the pressure roller 172. Also, the sponge roller 181 is driven, by drive means not shown, to rotate against rotation of the pressure roller 172, while the metal roller 182 rotates accompanying the rotation of the sponge roller 181. Here, examples of the materials for the sponge roller 181 include rubber foam such as urethane rubber (urethane foam) or silicone rubber (silicone foam). Examples of the materials for the metal roller 182 include a metal such as a free-cutting metal material (SUM material), a stainless steel material (SUS material), aluminum, iron or copper, or an alloy of any of these. However, the above materials are not limited thereto.

With the above configuration, the sponge roller 181 is made of resin while the metal roller 182 is literally made of a metal. Thus, the metal roller 182 can absorb the radiant heat from the pressure roller 172 more effectively, which results in the temperature of the metal roller 182 being maintained higher than the temperature of the sponge roller 181. Since the temperature of the metal roller 182 is maintained higher than the temperature of the sponge roller 181, it is possible to fuse or soften, to a certain extent, the toner that adheres to a part of the sponge roller 181, the part making contact with the metal roller 182. Accordingly, the toner can more reliably adhere to the metal roller 182 from the sponge roller 181.

Furthermore, in the first embodiment, the cleaning means 180 further includes a cleaning pad 183 that cleans the metal roller 182.

The cleaning pad 183 is supported by and secured to the main body frame FL by a support plate (support member) 184 in a state in which the cleaning pad 183 is pressed against a roller surface of the metal roller 182. Also, the support plate 184 is made of, for example, a metal material such as a free-cutting metal material (SUM material), a stainless steel material (SUS material), aluminum, iron or copper. The support plate 184 is disposed adjacent to the pressure roller 172 so that they face each other without interference of the sponge roller 181. That is, the support plate 184 is also disposed to receive directly the radiant heat from the pressure roller 172.

With the above configuration, the support plate 184 can also absorb the radiant heat from the pressure roller 172 more effectively, which results in the temperature of the support plate 184 being raised. Therefore, the support plate 184 can play a subsidiary role in maintenance of the temperature of the metal roller 182 higher than the temperature of the sponge roller 181 due to heat conduction via the cleaning pad 183 supported by the support plate 184 (or due to radiant heat directly from the support plate 184).

In the fixing device 17 configured as above, in the state of being installed in the main body 300 of the image forming apparatus 100 (see FIG. 1), a drive mechanism (not shown) such as a gear on the side of the main body 300 meshes with a gear (not shown) provided on the rotating shaft 171*a* of the fixing roller 171, and rotational driving force from the drive mechanism on the side of the main body 300 is transferred to the rotating shaft 171*a* of the fixing roller 171 via the gear, and thereby the fixing roller 171 is driven to rotate in a predetermined rotational direction E1. The pressure roller 172 is caused to rotate as a result of the rotation of the fixing roller 171, in a reverse rotational direction E2 that is opposite to the rotational direction E1 of the fixing roller 171. The recording sheet P is sandwiched and transported between the fixing roller 171 and the pressure roller 172, and is heated and pressurized in the fixing nip portion N. Thus, the unfixed toner T on the recording sheet P is fused, mixed, and pressed so as to be thermally fixed.

When part of the minute substances such as toner and paper powder that have adhered to the roller surface 171*d* of the fixing roller 171 adhere to the roller surface 172*d* of the pressure roller 172, such minute substances are scraped off by unevenness portions of the roller surface 181*a* of the sponge roller 181 (i.e., angled edges formed by the roller surface of the sponge roller 181 and by respective air-accumulating groove portions due to air-accumulating parts that appear in the roller surface when the roller surface is processed to have an cylindrical shape) so as to adhere to the roller surface 181*a* of the sponge roller 181. Then, the minute substances re-adhere to the roller surface of the metal roller 182 from the roller surface 181*a* of the sponge roller 181 so as to be collected. The minute substances (in particular, paper powder) collected by the metal roller 182 are further collected by the cleaning pad 183.

At this time, since the temperature of the metal roller 182 is higher than the temperature of the sponge roller 181 as described above, the toner is reliably collected by the metal roller 182. Unlike the toner, the paper powder does not have viscosity. Therefore, even when the paper powder is once collected by the metal roller 182, sometimes part of the collected paper powder slips through the cleaning pad 183 to return to the sponge roller 181. However, even when the paper powder returns to the pressure roller 172 from the sponge roller 181 to re-adhere to the recording sheet P, the re-adhering paper powder not having viscosity unlike the toner can be brushed away.

Second Embodiment

Figure 4:
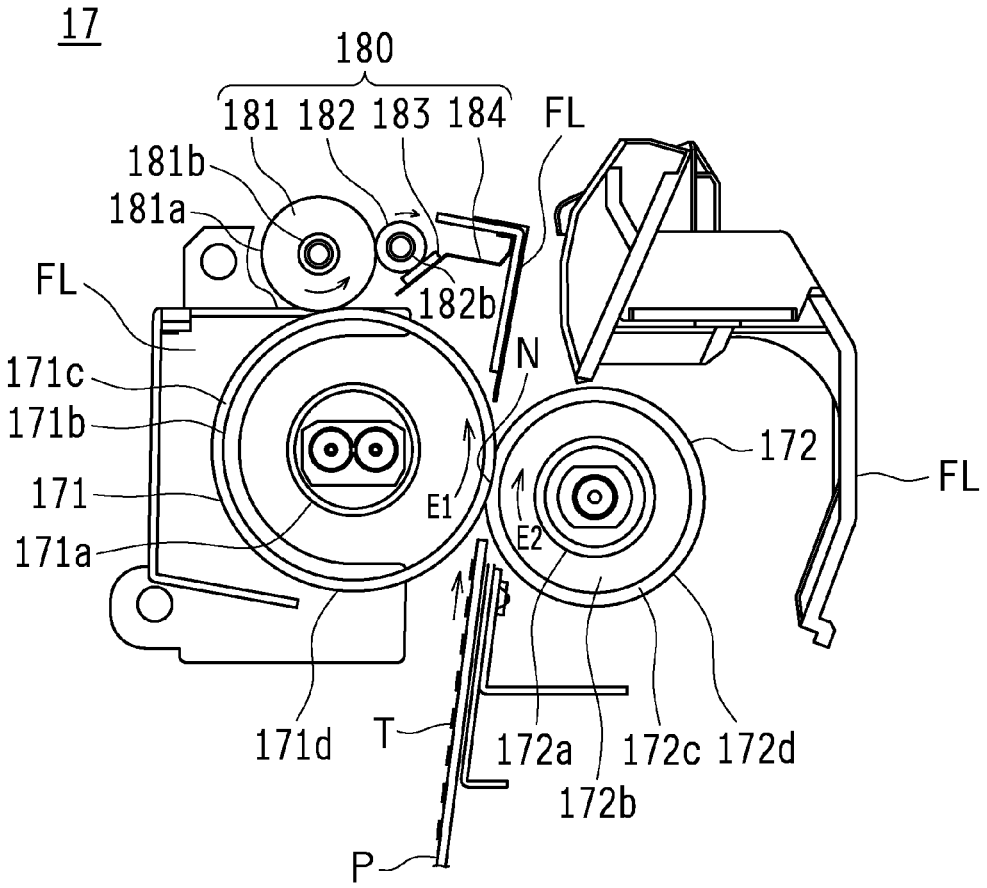
FIG. 4 is a schematic longitudinal cross-sectional view showing a main part, viewed from the front side, of the fixing device according to a second embodiment.
Figure 5:
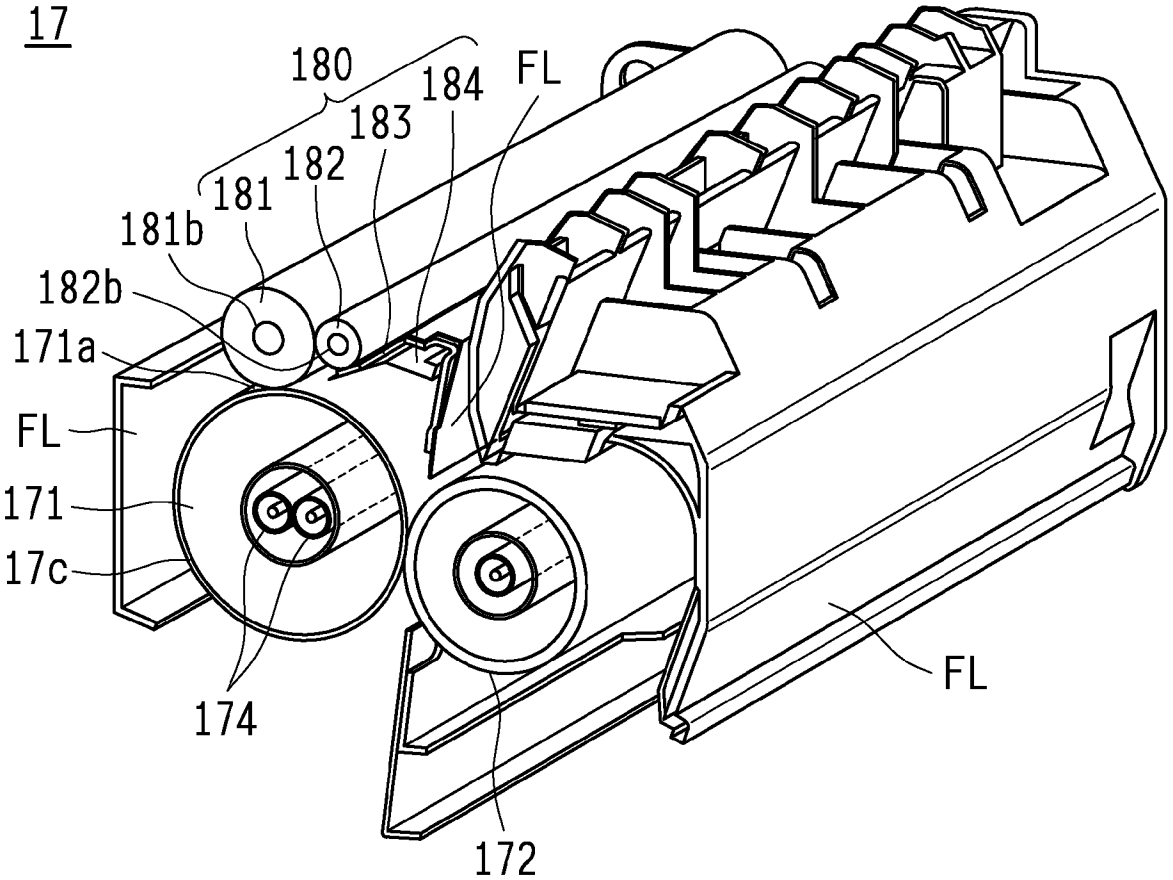
FIG. 5 is a perspective view showing partly a schematic cross-section viewed from the front side of the main part of the fixing device according to the second embodiment.

FIG. 4 is a schematic longitudinal cross-sectional view showing a main part, viewed from the front side, of the fixing device 17 according to the second embodiment. FIG. 5 is a perspective view showing partly a schematic cross-section viewed from the front side of the main part of the fixing device 17 according to the second embodiment.

In the fixing device 17 according to the first embodiment, the cleaning means 180 is provided on the side of the pressure roller 172, while in the second embodiment, the cleaning means 180 is provided on the side of the fixing roller 171. The configuration other than the location of the cleaning means 180 is the same as the configuration of the fixing device 17 of the first embodiment. Thus, detailed description on the above configuration is omitted here, provided that the same reference numerals are used to indicate the same members.

That is, in the second embodiment, the cleaning means 180 includes: the sponge roller 181 that is pressed against the roller surface 171*d* of the fixing roller 171; and the metal roller 182 that is pressed against the roller surface 181*a* of the sponge roller 181. The metal roller 182 is disposed in the vicinity of the fixing roller 171. In the second embodiment, the metal roller 182 is disposed adjacent to the fixing roller 171 so that they face each other without interference of the sponge roller 181. Thus, the metal roller 182 is disposed to receive directly radiant heat from the fixing roller 171.

The rotating shaft 181*b* of the sponge roller 181 and the rotating shaft 182*b* of the metal roller 182 are disposed in parallel with the rotating shaft 171*a* of the fixing roller 171. Also, the sponge roller 181 is driven, by drive means not shown, to rotate against rotation of the fixing roller 171, while the metal roller 182 rotates accompanying the rotation of the sponge roller 181. Here, the materials for the sponge roller 181 and the metal roller 182 are the same as in the first embodiment.

Furthermore, in the second embodiment, the cleaning means 180 further includes the cleaning pad 183 that cleans the metal roller 182.

The cleaning pad 183 is supported by and secured to the main body frame FL by the support plate 184 in a state in which the cleaning pad 183 is pressed against the roller surface of the metal roller 182. Also, the support plate 184 is made of, for example, a metal material such as a free-cutting metal material (SUM material), a stainless steel material (SUS material), aluminum, iron or copper. The support plate 184 is disposed adjacent to the fixing roller 171 so that they face each other without interference of the sponge roller 181. That is, the support plate 184 is also disposed to receive directly the radiant heat from the heat source 174 of the fixing roller 171.

With the above configuration, the metal roller 182 can absorb the radiant heat from the fixing roller 171 more effectively, which results in the temperature of the metal roller 182 being maintained higher than the temperature of the sponge roller 181. Since the temperature of the metal roller 182 is maintained higher than the temperature of the sponge roller 181, it is possible to fuse or soften, to a certain extent, the toner that adheres to a part of the sponge roller 181, the part making contact with the metal roller 182. Accordingly, the toner can more reliably adhere to the metal roller 182 from the sponge roller 181.

The support plate 184 can also absorb the radiant heat from the fixing roller 171 more effectively, which results in the temperature of the support plate 184 being raised. Therefore, the support plate 184 can play a subsidiary role in maintenance of the temperature of the metal roller 182 higher than the temperature of the sponge roller 181 due to heat conduction via the cleaning pad 183 supported by the support plate 184 (or due to radiant heat directly from the support plate 184).

Note that the operation of the cleaning means 180 according to the second embodiment is the same as the operation described in the first embodiment. Thus, description on the operation of the cleaning means 180 is omitted here.

Third Embodiment

Figure 6:
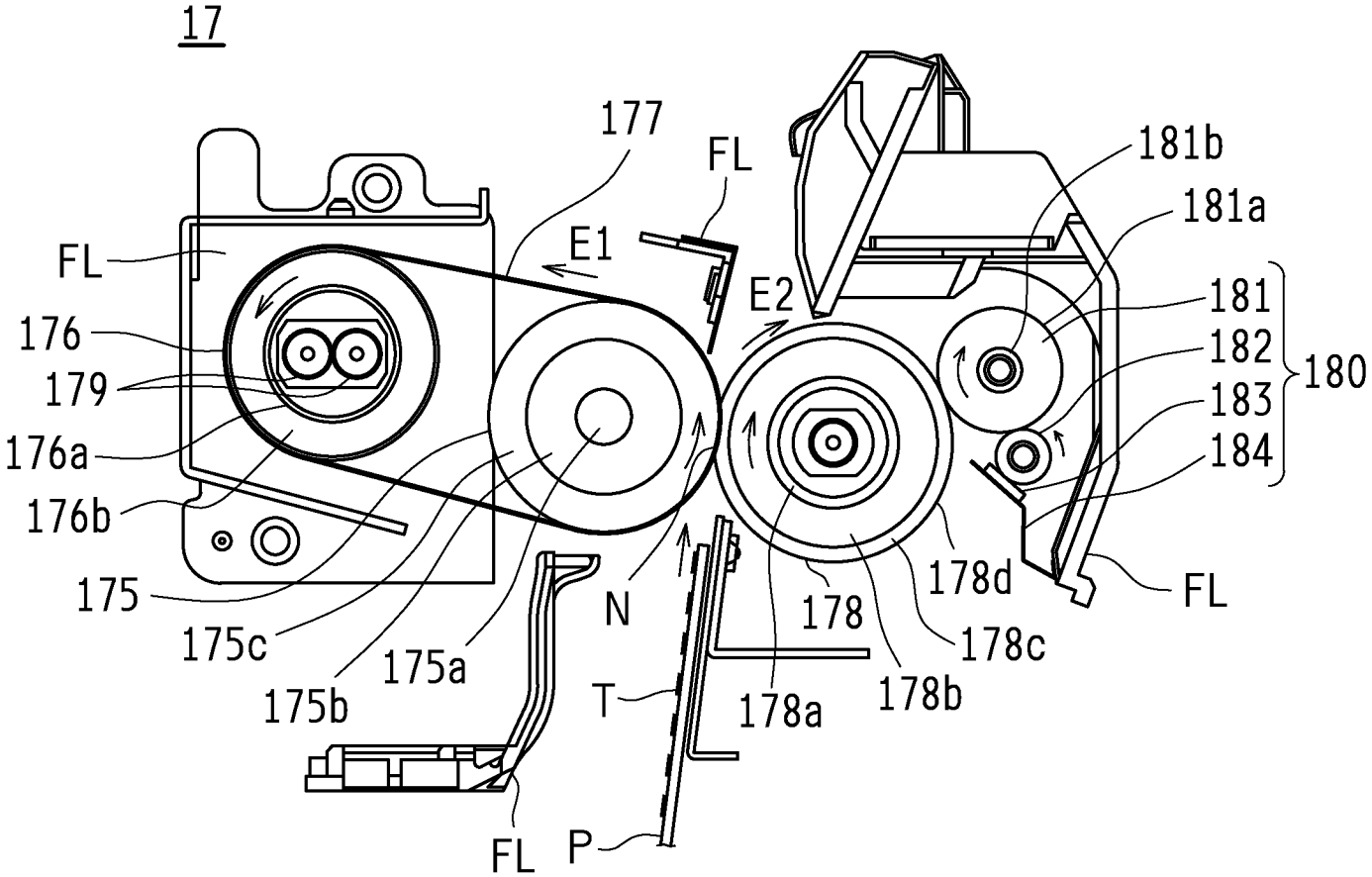
FIG. 6 is a schematic longitudinal cross-sectional view showing a main part, viewed from the front side, of the fixing device according to a third embodiment.
Figure 7:
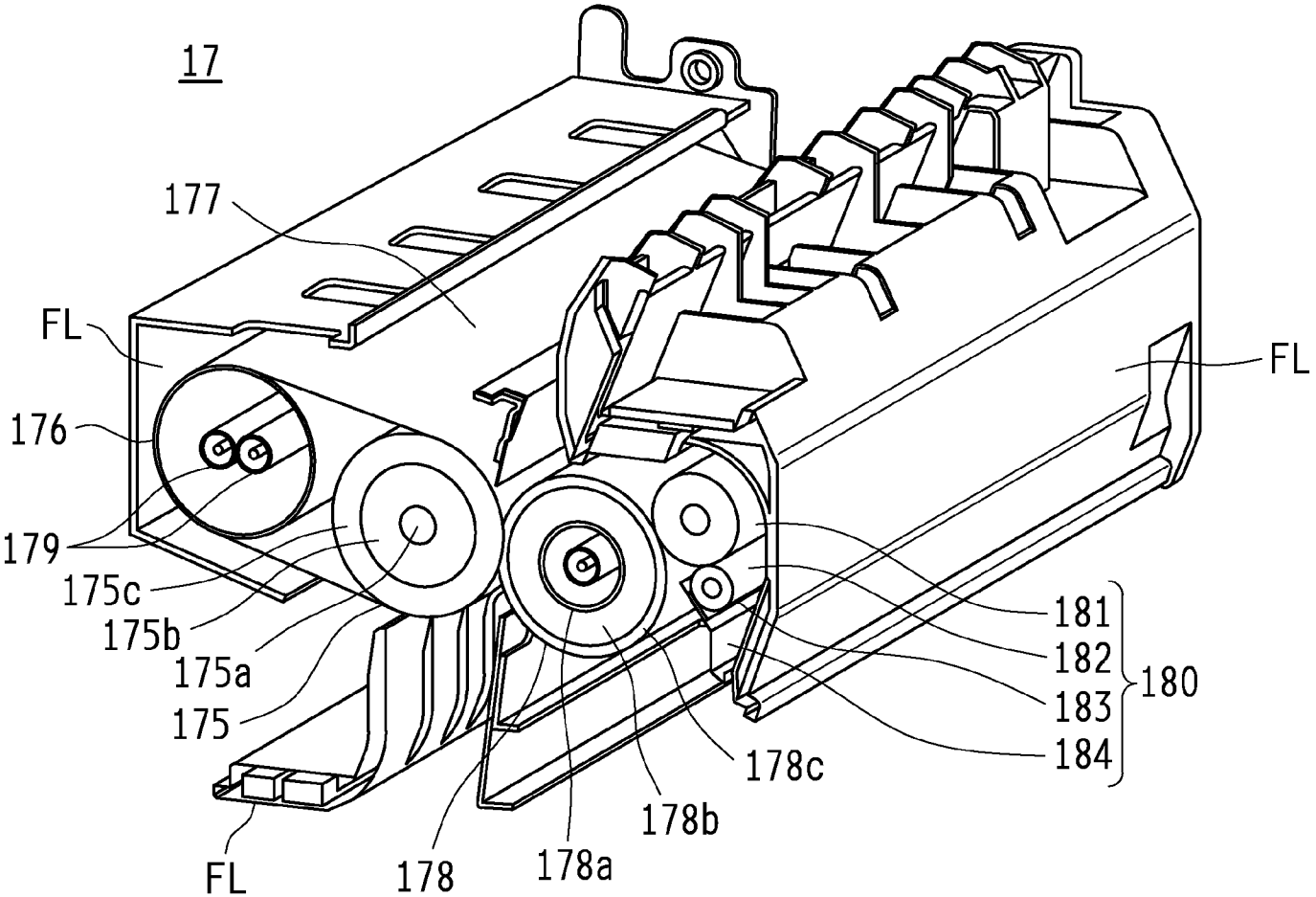
FIG. 7 is a perspective view showing partly a schematic cross-section viewed from the front side of the main part of the fixing device according to the third embodiment.

FIG. 6 is a schematic longitudinal cross-sectional view showing a main part, viewed from the front side, of the fixing device 17 according to the third embodiment. FIG. 7 is a perspective view showing partly a schematic cross-section viewed from the front side of the main part of the fixing device 17 according to the third embodiment. The fixing device 17 according to the third embodiment is a belt fixing type fixing device.

The fixing device 17 includes: a plurality of (here, two) rollers including a fixing roller 175 (i.e., the fixing roller 175 and a heating roller 176 here); and a fixing belt 177 that is an endless belt wound on the fixing roller 175 and the heating roller 176.

The fixing device 17 further includes a pressure roller 178. The fixing roller 175 and the pressure roller 178 press against each other with the fixing belt 177 being interposed therebetween, thereby forming the fixing nip portion N that is a fixing nip region between the fixing roller 177 and the pressure roller 178.

The fixing roller 175 faces the unfixed toner T on the recording sheet P via the fixing belt 177, while the heating roller 176 heats the fixing belt 177.

Specifically, the fixing roller 175 faces the unfixed toner T on the recording sheet P with the fixing belt 177 being interposed therebetween. Thus, in a state in which the fixing belt 177 is interposed between the fixing roller 175 and the pressure roller 178, the fixing roller 175 faces the unfixed toner T on the recording sheet P and presses, together with the pressure roller 178, the unfixed toner T on the recording sheet P that is between the fixing belt 177 and the pressure roller 178.

The fixing roller 175 includes a rotating shaft 175*a* that is rotatably provided in the main body frame FL of the fixing device 17 via a bearing (not shown). The fixing roller 175 includes a core metal 175*b* and an elastic layer 175*c* having elasticity (cushioning property, or flexibility).

Specifically, the elastic layer 175*c* is provided on an exterior surface of the core metal 175*b* of the fixing roller 175. That is, the fixing roller 175 is a roller, on the exterior surface of which the elastic layer 175*c* is formed.

The core metal 175*b* is constituted by a columnar-shaped (solid) metal core material. For the core metal 175*b*, it is possible to use, for example, a metal such as a free-cutting metal material (SUM material), a stainless steel material (SUS material), aluminum, iron or copper, or an alloy of any of these.

For the elastic layer 175*c*, it is possible to use, for example, a porous resin material or a foamed resin material. Representative examples of the foamed resin materials include rubber foam such as urethane rubber (urethane foam) or silicone rubber (silicone foam).

The heating roller 176 includes a rotating shaft 176*a* that is rotatably provided in the main body frame FL of the fixing device 17 via a bearing (not shown). The heating roller 176 includes a cylindrical-shaped core metal 176*b*. A heat source (here, a halogen heater lamp) 179 for heating the heating roller 176 is provided inside the core metal 176*b*. Thereby, the heating roller 176 is heated by the heat source 179 so that the heat of the heating roller 176 is conducted to the fixing belt 177. The heat is further conducted to the roller surface of the fixing roller 175 via the fixing belt 177 so as to heat the fixing roller 175.

The fixing belt 177 has a two-layer structure in which a synthetic resin material (e.g., fluororesin such as PFA or PTFE) having excellent heat resistance and releasability is formed, as a release layer, on the surface of a cylindrical-shaped base body having flexibility. Also, a coating of fluororesin or the like may be applied on the interior surface of a belt base member to reduce skew force of the fixing belt 177.

The pressure roller 178 includes a rotating shaft 178*a* that is rotatably provided in the main body frame FL of the fixing device 17 via a bearing (not shown). The pressure roller 178 includes a core metal 178*b* and a release layer 178*c* having releasability. The release layer 178*c* is disposed on the core metal 178*b*.

The core metal 178*b* is constituted by a metal core material in a shape of a hollow cylinder. For the core metal 178*b*, it is possible to use the same material as used for the fixing roller 175.

For the release layer 178*c*, it is possible to use, for example, fluororesin such as PFA (copolymer of tetrafluoroethylene and perfluoroalkylvinylether) or PTFE (polytetrafluoroethylene).

Also, the pressure roller 178 is provided with the cleaning means 180 for collecting minute substances such as toner and paper powder that adhere to a roller surface 178*d* (specifically, the surface of the release layer 178*c*) of the pressure roller 178.

The cleaning means 180 includes: the sponge roller 181 that is pressed against the roller surface 178*d* of the pressure roller 178; and a metal roller 182 that is pressed against the roller surface 181*a* of the sponge roller 181. The metal roller 182 is disposed in the vicinity of the pressure roller 178. In the third embodiment, the metal roller 182 is disposed adjacent to the pressure roller 178 so that they face each other without interference of the sponge roller 181. Thus, the metal roller 182 is disposed to receive directly radiant heat from the pressure roller 178.

A rotating shaft 181*b* of the sponge roller 181 and the rotating shaft 182*b* of the metal roller 182 are disposed in parallel with the rotating shaft 178*a* of the pressure roller 178. Also, the sponge roller 181 is driven, by drive means not shown, to rotate against rotation of the pressure roller 178, while the metal roller 182 rotates accompanying the rotation of the sponge roller 181. Here, examples of the materials for the sponge roller 181 include silicone resin, while examples of the materials for the metal roller 182 include stainless steel. However, the above materials are not limited thereto.

With the above configuration, the sponge roller 181 is made of resin while the metal roller 182 is literally made of a metal. Thus, the metal roller 182 can absorb the radiant heat from the pressure roller 178 more effectively, which results in the temperature of the metal roller 182 being maintained higher than the temperature of the sponge roller 181. Since the temperature of the metal roller 182 is maintained higher than the temperature of the sponge roller 181, it is possible to fuse or soften, to a certain extent, the toner that adheres to a part of the sponge roller 181, the part making contact with the metal roller 182. Accordingly, the toner can more reliably adhere to the metal roller 182 from the sponge roller 181.

Furthermore, in the third embodiment, the cleaning means 180 further includes the cleaning pad 183 that cleans the metal roller 182.

The cleaning pad 183 is supported by and secured to the main body frame FL by the support plate 184 in a state in which the cleaning pad 183 is pressed against the roller surface of the metal roller 182. Also, the support plate 184 is made of, for example, a metal material such as stainless steel. The support plate 184 is disposed adjacent to the pressure roller 178 so that they face each other without interference of the sponge roller 181. That is, the support plate 184 is also disposed to receive directly the radiant heat from the pressure roller 178.

With the above configuration, the support plate 184 can also absorb the radiant heat from the pressure roller 178 more effectively, which results in the temperature of the support plate 184 being raised. Therefore, the support plate 184 can play a subsidiary role in maintenance of the temperature of the metal roller 182 higher than the temperature of the sponge roller 181 due to heat conduction via the cleaning pad 183 supported by the support plate 184 (or due to radiant heat directly from the support plate 184).

In the fixing device 17 configured as above, in the state of being installed in the main body 300 of the image forming apparatus 100 (see FIG. 1), a drive mechanism (not shown) such as a gear on the side of the main body 300 meshes with a gear (not shown) provided on the rotating shaft 175*a* of the fixing roller 175, and rotational driving force from the drive mechanism on the side of the main body 300 is transferred to the rotating shaft 175*a* of the fixing roller 175 via the gear, and thereby the fixing roller 175 is driven to rotate in the predetermined rotational direction E1. According to the rotation of the fixing roller 175, the fixing belt 177 moves around in the same circulating direction as the rotational direction E1 of the fixing roller 175 so that the heating roller 176 rotates in the rotational direction E1. Furthermore, the pressure roller 178 is caused to rotate as a result of the rotation of the fixing roller 175, in the reverse rotational direction E2 that is opposite to the rotational direction E1 of the fixing roller 175. The recording sheet P is sandwiched and transported between the fixing belt 177 and the pressure roller 178, and is heated and pressurized in the fixing nip portion N. Thus, the unfixed toner T on the recording sheet P is fused, mixed, and pressed so as to be thermally fixed.

Note that, in this case, the operation of the cleaning means 180 is the same as the operation described in the first embodiment. Thus, description on the operation of the cleaning means 180 is omitted here.

The fixing device 17 may include a tension roller that is disposed inside or outside the fixing belt 177 and that presses the fixing belt 177 against the inside or outside thereof so as to apply tensile force to the fixing belt 177. In place of or in addition to the tension roller, the fixing device 17 may include a biasing member (e.g., coil spring) that applies biasing force to both end portions of the rotating shaft 176*a* of the heating roller 176, the biasing force in the direction opposite to the fixing roller 175. Also, a heat source may be included in the fixing roller 175 or the pressure roller 178, or in each of the fixing roller 175 and the pressure roller 178. In the case where the tension roller is provided, the tension roller may include a heat source. In the case where the fixing belt 177 is further wound on other rollers, at least one of the other rollers may include a heat source.

Fourth Embodiment

Figure 8:
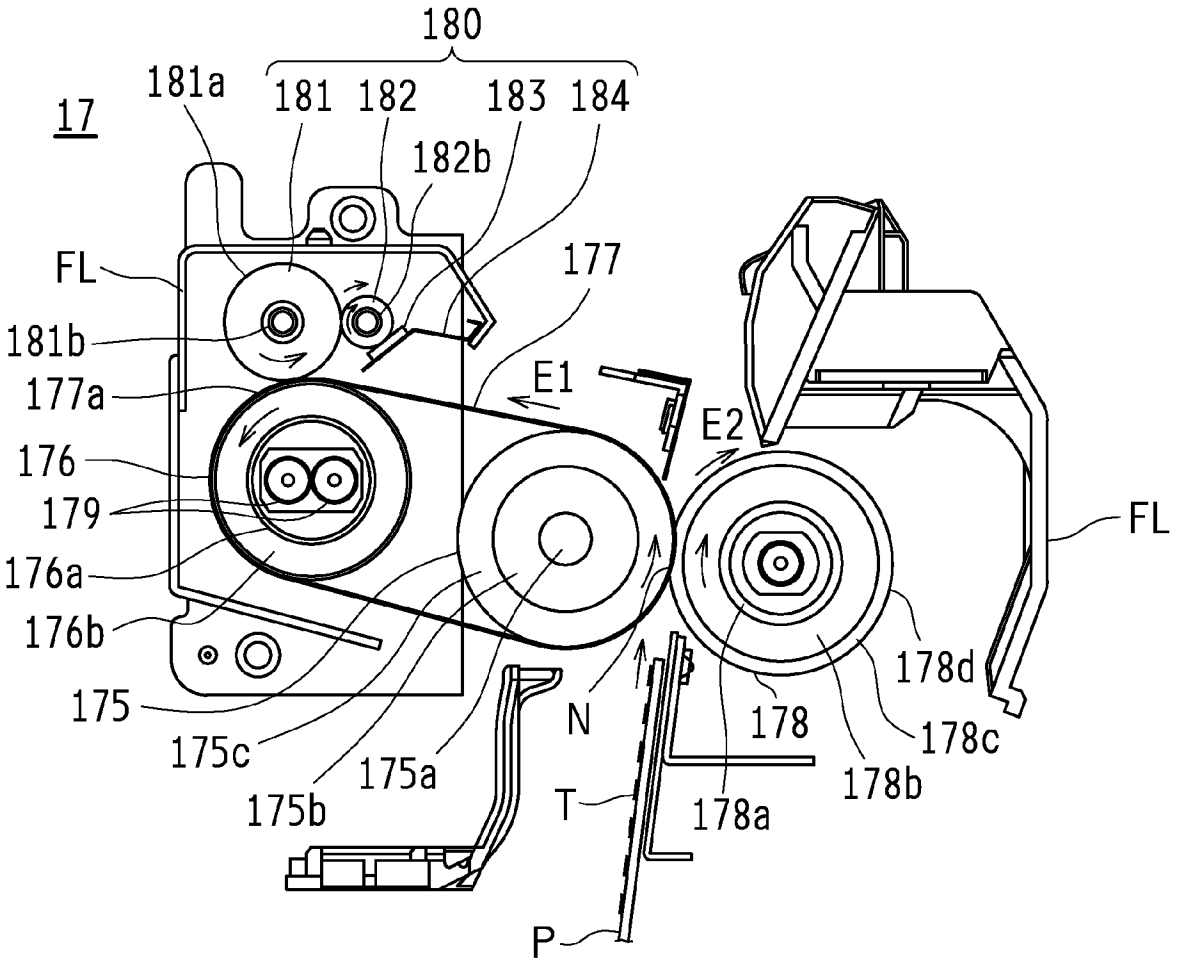
FIG. 8 is a schematic longitudinal cross-sectional view showing a main part, viewed from the front side, of the fixing device according to a fourth embodiment.
Figure 9:
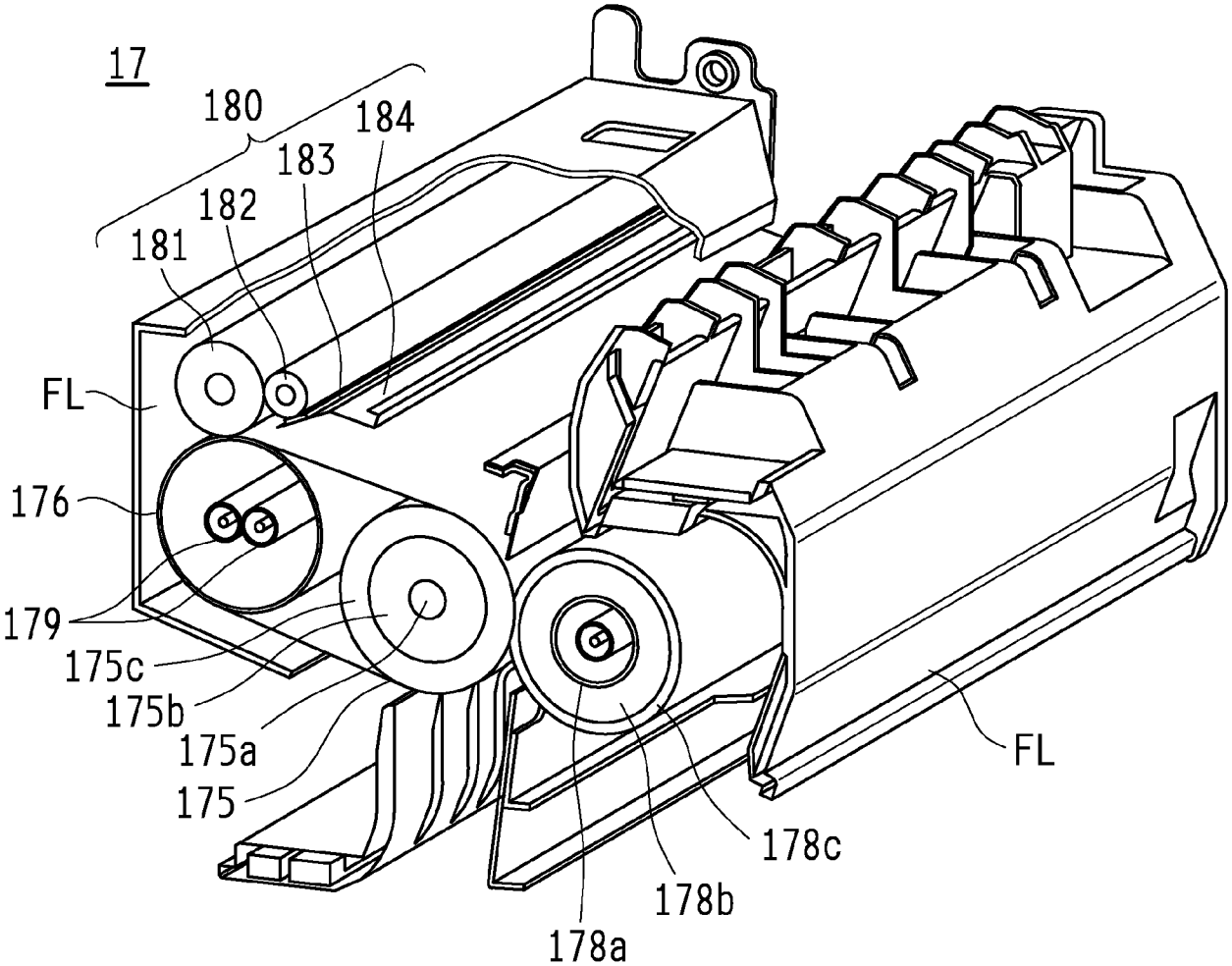
FIG. 9 is a perspective view showing partly a schematic cross-section viewed from the front side of the main part of the fixing device according to the fourth embodiment.

FIG. 8 is a schematic longitudinal cross-sectional view showing a main part, viewed from the front side, of the fixing device 17 according to the fourth embodiment. FIG. 9 is a perspective view showing partly a schematic cross-section viewed from the front side of the main part of the fixing device 17 according to the fourth embodiment.

In the fixing device 17 according to the third embodiment, the cleaning means 180 is provided on the side of the pressure roller 178, while in the fourth embodiment, the cleaning means 180 is provided on the side of the fixing roller 175, more specifically, on the side of the heating roller 176. The configuration other than the location of the cleaning means 180 is the same as the configuration of the fixing device 17 of the third embodiment. Thus, detailed description on the above configuration is omitted here, provided that the same reference numerals are used to indicate the same members.

That is, in the fourth embodiment, the cleaning means 180 includes: the sponge roller 181 that is pressed against a belt surface 177*a* of the fixing belt 177 via the heating roller 176; and a metal roller 182 that is pressed against the roller surface 181*a* of the sponge roller 181. The metal roller 182 is disposed in the vicinity of the heating roller 176. In the fourth embodiment, the metal roller 182 is disposed adjacent to the heating roller 176 so that they face each other, with the fixing belt 177 being interposed therebetween, without interference of the sponge roller 181. Thus, the metal roller 182 is disposed to receive directly radiant heat from the heating roller 176.

The rotating shaft 181*b* of the sponge roller 181 and the rotating shaft 182*b* of the metal roller 182 are disposed in parallel with the rotating shaft 176*a* of the heating roller 176. Also, the sponge roller 181 is driven, by drive means not shown, to rotate against rotation of the fixing belt 177, while the metal roller 182 rotates accompanying the rotation of the sponge roller 181. Here, the materials of the sponge roller 181 and the metal roller 182 are the same as in the first embodiment.

In the fourth embodiment also, the cleaning means 180 further includes the cleaning pad 183 that cleans the metal roller 182.

The cleaning pad 183 is supported by and secured to the main body frame FL by the support plate 184 in a state in which the cleaning pad 183 is pressed against the roller surface of the metal roller 182. Also, the support plate 184 is made of, for example, a metal material such as stainless steel. The support plate 184 is disposed adjacent to the heating roller 176 so that they face each other without interference of the sponge roller 181. That is, the support plate 184 is also disposed to receive directly the radiant heat from the heat source 179 of the heating roller 176.

With the above configuration, the metal roller 182 can absorb the radiant heat from the heating roller 176 more effectively, which results in the temperature of the metal roller 182 being maintained higher than the temperature of the sponge roller 181. Since the temperature of the metal roller 182 is maintained higher than the temperature of the sponge roller 181, it is possible to fuse or soften, to a certain extent, the toner that adheres to a part of the sponge roller 181, the part making contact with the metal roller 182. Accordingly, the toner can more reliably adhere to the metal roller 182 from the sponge roller 181.

Also, the support plate 184 can also absorb the radiant heat from the heating roller 176 more effectively, which results in the temperature of the support plate 184 being raised. Therefore, the support plate 184 can play a subsidiary role in maintenance of the temperature of the metal roller 182 higher than the temperature of the sponge roller 181 due to heat conduction via the cleaning pad 183 supported by the support plate 184 (or due to radiant heat directly from the support plate 184).

Note that the operation of the cleaning means 180 according to the fourth embodiment is the same as the operation described in the first embodiment. Thus, description on the operation of the cleaning means 180 is omitted here.

In the first to fourth embodiments as described above, the cleaning means 180 is provided on either of the fixing roller side or the pressure roller side. However, the cleaning means 180 may be provided on both of the fixing roller (heating roller) side and the pressure roller side.

Also, in the first to fourth embodiments as described above, the unevenness portions of the roller surface 181*a* of the sponge roller 181 for scraping off the minute substances that adhere to the surface of the fixing member is described as the angled edges formed by the roller surface of the sponge roller 181 and by respective air-accumulating groove portions due to air-accumulating parts that appear in the roller surface when the roller surface are processed to have the cylindrical shape. However, apart from the angled edges of the roller surface, the unevenness portions may be more aggressively formed by uniformly disposing a number of small protrusions in a random manner over the entire surface of the roller. In this way, it is possible to improve an effect of scraping the minute substances by the sponge roller 181.

The embodiments disclosed herein should be considered in all respects as illustrative and should not be interpreted in a limited manner. Therefore, the scope of the invention is indicated by the appended claims rather than by the foregoing description, and all modifications and changes that come within the meaning and range of equivalency of the claims are intended to be embraced therein.

DESCRIPTION OF THE REFERENCE NUMERALS

17 Fixing device
171 Fixing roller (example of fixing member)
171*a* Rotating shaft
171*b* Core metal
171*c* Surface layer
171*d* Roller surface
172 Pressure roller (example of fixing member)
172*a* Rotating shaft
172*b* Core metal
172*c* Release layer
172*d* Roller surface
174 Heat source
175 Fixing roller
175*a* Rotating shaft
175*b* Core metal
175*c* Elastic layer
176 Heating roller
176*a* Rotating shaft
176*b* Core metal
177 Fixing belt
178 Pressure roller
178*a* Rotating shaft
178*b* Core metal
178*c* Release layer
179 Heat source
180 Cleaning means
181 Sponge roller
181*a* Roller surface
181*b*, 182*b* Rotating shaft
182 Metal roller
183 Cleaning pad
184 Support plate (support member)
100 Image forming apparatus
300 Main body
FL Main body frame
P Recording sheet
T Toner

What is claimed is:

1. A fixing device, comprising:
a cleaning member configured to clean a fixing member; and
a re-adhering member to which toner that adheres to the cleaning member is caused to re-adhere,
wherein the re-adhering member is disposed so as to face the fixing member,
a surface of the cleaning member, which makes contact with the fixing member, is constituted by a nonmetal member, and
a surface of the re-adhering member, which makes contact with the cleaning member, is constituted by a metal member.

2. The fixing device according to claim 1,
wherein the re-adhering member is disposed at a location where a temperature of the re-adhering member is higher than a temperature of the cleaning member.

3. The fixing device according to claim 1, further comprising a cleaning pad configured to clean the re-adhering member.

4. The fixing device according to claim 3,
wherein a support member that supports the cleaning pad is a metal member.

5. The fixing device according to claim 4,
wherein the support member that supports the cleaning pad is disposed so as to face the fixing member.

6. The fixing device according to claim 1,
wherein the cleaning member and the re-adhering member are disposed downstream in a direction in which a sheet is transported.

7. The fixing device according to claim 1,
wherein the fixing member is constituted by a heating member and a pressure member that form a fixing nip portion, and
wherein the cleaning member and the re-adhering member are provided on either one or both of the heating member and the pressure member.

8. The fixing device according to claim 7,
wherein the heating member is a fixing roller or a fixing belt, and
wherein the pressure member is a pressure roller.

9. An image forming apparatus comprising the fixing device according to claim 1.

10. A fixing device, comprising:
a cleaning member configured to clean a fixing member; and a re-adhering member to which toner that adheres to the cleaning member is caused to re-adhere, wherein the re-adhering member is disposed so as to face the fixing member, and the re-adhering member is disposed at a location where a temperature of the re-adhering member is higher than a temperature of the cleaning member.

11. The fixing device according to claim 10, further comprising a cleaning pad configured to clean the re-adhering member.

12. The fixing device according to claim 11, wherein a support member that supports the cleaning pad is a metal member.

13. The fixing device according to claim 12, wherein the support member that supports the cleaning pad is disposed so as to face the fixing member.

14. The fixing device according to claim 10, wherein the cleaning member and the re-adhering member are disposed downstream in a direction in which a sheet is transported.

15. An image forming apparatus comprising the fixing device according to claim 10.

16. A fixing device, comprising:

a cleaning member configured to clean a fixing member;

a re-adhering member to which toner that adheres to the cleaning member is caused to re-adhere; and a cleaning pad configured to clean the re-adhering member, wherein the re-adhering member is disposed so as to face the fixing member.

17. The fixing device according to claim 16, wherein a support member that supports the cleaning pad is a metal member.

18. The fixing device according to claim 17, wherein the support member that supports the cleaning pad is disposed so as to face the fixing member.

19. The fixing device according to claim 16, wherein the cleaning member and the re-adhering member are disposed downstream in a direction in which a sheet is transported.

20. An image forming apparatus comprising the fixing device according to claim 16.

* * * * *